US010249283B2

(12) United States Patent
Zhou et al.

(10) Patent No.: US 10,249,283 B2
(45) Date of Patent: Apr. 2, 2019

(54) TONE AND HOWL SUPPRESSION IN AN ANC SYSTEM

(71) Applicant: Cirrus Logic International Semiconductor Ltd., Edinburgh (GB)

(72) Inventors: Dayong Zhou, Austin, TX (US); Yang Lu, Cedar Park, TX (US); Jeffrey D. Alderson, Austin, TX (US); Eric King, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 15/669,647

(22) Filed: Aug. 4, 2017

(65) Prior Publication Data

US 2019/0043467 A1 Feb. 7, 2019

(51) Int. Cl.

| | |
|---|---|
| ***H04R 3/04*** | (2006.01) |
| ***G10K 11/178*** | (2006.01) |
| ***G10L 25/21*** | (2013.01) |
| ***G10L 25/51*** | (2013.01) |

(52) U.S. Cl.

CPC ..... *G10K 11/178* (2013.01); *G10L 25/21* (2013.01); *G10L 25/51* (2013.01); *H04R 3/04* (2013.01); *G10K 2210/3028* (2013.01); *G10K 2210/3044* (2013.01)

(58) Field of Classification Search

CPC ..... G10K 11/178; G10K 11/002; G10K 2210/1081; H04R 1/008; H04R 1/1083; H04R 3/005; H04R 2420/01; G10L 21/0208

USPC ..... 381/71.1, 71.3, 71.11, 71.12

See application file for complete search history.

(56) References Cited

U.S. PATENT DOCUMENTS

| | | | | |
|---|---|---|---|---|
| 2011/0199142 | A1* | 8/2011 | Mu | H03D 7/166 327/299 |
| 2013/0083939 | A1* | 4/2013 | Fellers | G10K 11/178 381/71.11 |
| 2013/0301848 | A1* | 11/2013 | Zhou | G10K 11/16 381/71.11 |
| 2016/0300563 | A1* | 10/2016 | Park | G10K 11/1784 |
| 2017/0133000 | A1 | 5/2017 | Hendrix | |

OTHER PUBLICATIONS

Widrow et al., "Adaptive Noise Cancelling: Principles and Applications", Proceedings of the IEEE, Dec. 1975, vol. 63, pp. 1692-1716, New Jersey.

* cited by examiner

*Primary Examiner* — Melur Ramakrishnaiah

(74) *Attorney, Agent, or Firm* — Norton Rose Fulbright US LLP

(57) ABSTRACT

The handling of disturbances to audio signals may be improved with an adaptive noise cancellation (ANC) system that performs tone suppression and howl suppression in a collaborative manner. Such ANC systems may be configured to detect a first tone in an input signal at a first tone frequency and extract the detected first tone from the input signal. The ANC systems may also be configured to adaptively filter the extracted first tone to generate a second tone that has a magnitude that is approximately equal to a magnitude of the extracted first tone and a phase that is approximately opposite the phase of the extracted first tone. The ANC systems may be further configured to add the second tone to an intermediate signal that is based, at least in part, on the input signal to generate the output signal.

23 Claims, 8 Drawing Sheets

TONE AND HOWL SUPPRESSION IN AN ANC SYSTEM

FIELD OF THE DISCLOSURE

The instant disclosure relates to adaptive noise cancellation (ANC) systems. More specifically, portions of this disclosure relate to tone and howl suppression performed in an ANC system. The introduced techniques can also be applied to other adaptive filter applications, such as acoustic echo cancellation (AEC).

BACKGROUND

Wireless telephones, such as mobile/cellular telephones and cordless telephones, and other consumer audio devices, such as mp3 players, are in widespread use. Performance of such devices with respect to audio intelligibility can be improved by providing noise canceling using a microphone. In noise cancellation, the microphone measures ambient acoustic events and then inserts an anti-noise signal into the output of the device to cancel the ambient acoustic events measured by the microphone. The acoustic environment around personal audio devices can change dramatically, depending on the sources of noise that are present and the position of the device itself. An adaptive noise cancellation (ANC) system may be employed to adapt the noise canceling to take into account environmental changes. However, numerous drawbacks are associated with conventional ANC systems. For example, conventional ANC systems for tone and/or howl suppression can be complex, can consume significant power, and can have poor performance.

Shortcomings mentioned here are only representative and are included simply to highlight that a need exists for improved electrical components, particularly for improved ANC systems that perform tone and/or howl suppression. Embodiments described herein address certain shortcomings but not necessarily each and every one described here or known in the art.

SUMMARY

The performance of an ANC system may be improved with enhanced tone suppression. For example, an input signal, such as an audio signal, may include a disturbance tone at a particular frequency. To initiate reduction of the disturbance, the disturbance tone may be detected and extracted from the input signal. An adaptive filter may be used to generate a cancelation tone, such as a second tone that has a magnitude that is approximately equal to a magnitude of the extracted disturbance tone and a phase that is approximately opposite the phase of the extracted disturbance tone. The cancelation tone may be added back into the signal path to cancel or reduce the disturbance in the input signal caused by the disturbance tone.

The performance of an ANC system may also be improved by performing tone suppression and howl suppression collaboratively. Tone suppression may be the initial means for reducing the effect of disturbance in audio signals. When an ANC system determines that tone suppression alone was not sufficient, the ANC system may also implement howl suppression. By performing tone suppression and howl suppression in such a collaborative manner, the resources of an ANC system may be efficiently used to reduce the effect of disturbances in audio signals. The ANC system improvements may include reduction in power and memory usage, improvements in speed, reduction in complexity and cost, and improvements in robustness and flexibility.

According to one embodiment, a method includes: detecting a first tone in an input signal at a first tone frequency; extracting the detected first tone from the input signal; adaptively filtering the extracted first tone to generate a second tone that has a magnitude that is approximately equal to a magnitude of the extracted first tone and a phase that is approximately opposite the phase of the extracted first tone; and adding the second tone to an intermediate signal that is based, at least in part, on the input signal to generate the output signal. A controller may be configured in software or hardware to perform this method or similar methods.

In another embodiment, an apparatus may include an audio controller configured to perform steps that include: detecting a first tone in an input signal at a first tone frequency; extracting the detected first tone from the input signal; adaptively filtering the extracted first tone to generate a second tone that has a magnitude that is approximately equal to a magnitude of the extracted first tone and a phase that is approximately opposite the phase of the extracted first tone; and adding the second tone to an intermediate signal that is based, at least in part, on the input signal to generate the output signal.

In yet another embodiment, an apparatus may include: a signal processing block configured to detect a first tone in an input signal at a first tone frequency; an extraction block configured to extract the detected first tone from the input signal; an adaptive filter block configured to adaptively filter the extracted first tone to generate a second tone that has a magnitude that is approximately equal to a magnitude of the extracted first tone and a phase that is approximately opposite the phase of the extracted first tone; and an adder block configured to add the second tone to an intermediate signal that is based, at least in part, on the input signal to generate the output signal.

The foregoing has outlined rather broadly certain features and technical advantages of embodiments of the present invention in order that the detailed description that follows may be better understood. Additional features and advantages will be described hereinafter that form the subject of the claims of the invention. It should be appreciated by those having ordinary skill in the art that the conception and specific embodiment disclosed may be readily utilized as a basis for modifying or designing other structures for carrying out the same or similar purposes. It should also be realized by those having ordinary skill in the art that such equivalent constructions do not depart from the spirit and scope of the invention as set forth in the appended claims. Additional features will be better understood from the following description when considered in connection with the accompanying figures. It is to be expressly understood, however, that each of the figures is provided for the purpose of illustration and description only and is not intended to limit the present invention.

BRIEF DESCRIPTION OF THE DRAWINGS

For a more complete understanding of the disclosed systems and methods, reference is now made to the following descriptions taken in conjunction with the accompanying drawings. In the appended figures, similar components or features may have the same reference label. Further, various components of the same type may be distinguished by following the reference label with a second label that distinguishes among the similar components. If just the first reference label is used in the specification, the description is applicable to any one of the similar components having the same first reference label irrespective of the second reference label.

DETAILED DESCRIPTION

Figure 1A:
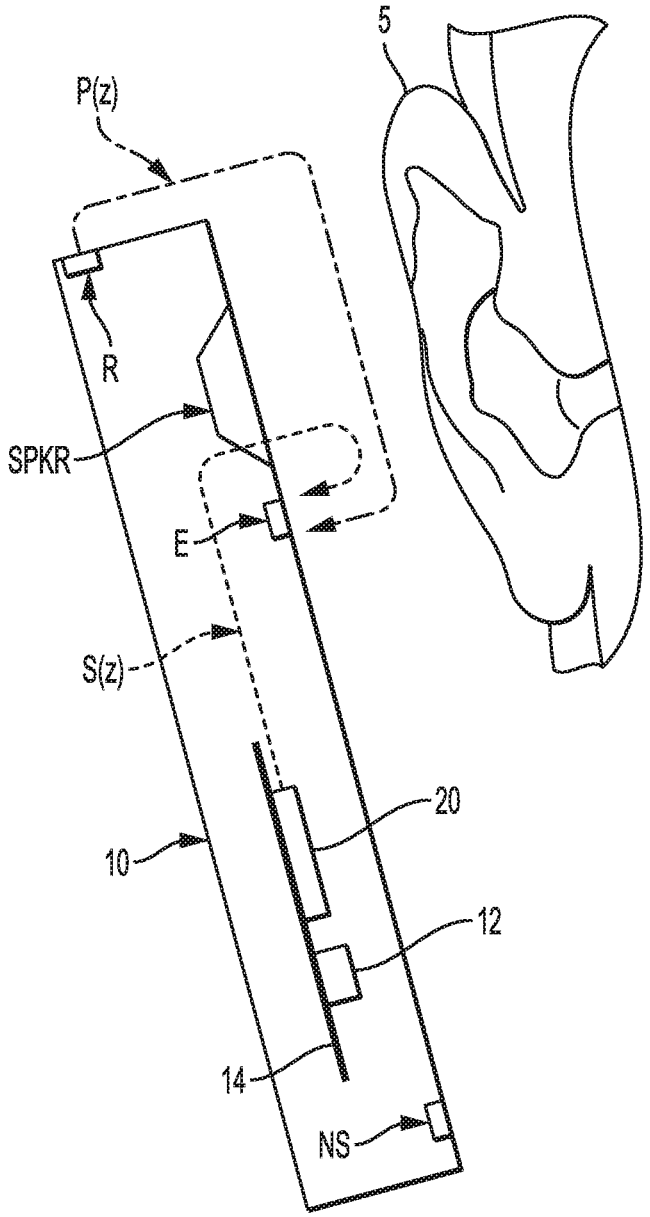
FIG. 1A is an illustration of an example wireless mobile telephone in accordance with embodiments of the present disclosure.

FIG. 1A is an illustration of an example wireless mobile telephone in accordance with embodiments of the present disclosure. In FIG. 1A, a wireless telephone 10 as illustrated in accordance with embodiments of the present disclosure is shown in proximity to a human ear 5. Wireless telephone 10 is an example of a device in which techniques in accordance with embodiments of the invention may be employed, but it is understood that not all of the elements or configurations embodied in illustrated wireless telephone 10, or in the circuits depicted in subsequent illustrations, are required in order to practice the invention recited in the claims. Wireless telephone 10 may include a transducer, such as speaker SPKR, that reproduces distant speech received by wireless telephone 10, along with other local audio events such as ringtones, stored audio program material, injection of near-end speech (i.e., the speech of the user of wireless telephone 10) to provide a balanced conversational perception, and other audio that requires reproduction by wireless telephone 10, such as sources from webpages or other network communications received by wireless telephone 10 and audio indications such as a low battery indication and other system event notifications. A near-speech microphone NS may be provided to capture near-end speech, which is transmitted from wireless telephone 10 to the other conversation participant(s).

Wireless telephone 10 may include adaptive noise cancellation (ANC) circuits and features that inject an anti-noise signal into speaker SPKR to improve intelligibility of the distant speech and other audio reproduced by speaker SPKR. A reference microphone R may be provided for measuring the ambient acoustic environment, and may be positioned away from the typical position of a user's mouth, so that the near-end speech may be minimized in the signal produced by reference microphone R. Another microphone, error microphone E, may be provided in order to further improve the ANC operation by providing a measure of the ambient audio combined with the audio reproduced by speaker SPKR close to ear 5, when wireless telephone 10 is in close proximity to ear 5. In different embodiments, additional reference and/or error microphones may be employed. Circuit 14 within wireless telephone 10 may include an audio CODEC integrated circuit (IC) 20 that receives the signals from reference microphone R, near-speech microphone NS, and error microphone E and interfaces with other integrated circuits such as a radio-frequency (RF) integrated circuit 12 having a wireless telephone transceiver. In some embodiments of the disclosure, the circuits and techniques disclosed herein may be incorporated in a single integrated circuit that includes control circuits and other functionality for implementing the entirety of the personal audio device, such as an MP3 player-on-a-chip integrated circuit. In these and other embodiments, the circuits and techniques disclosed herein may be implemented partially or fully in software and/or firmware embodied in computer-readable media and executable by a controller or other processing device.

ANC techniques may measure ambient acoustic events (as opposed to the output of speaker SPKR and/or the near-end speech) impinging on reference microphone R. By also measuring the same ambient acoustic events impinging on error microphone E, ANC processing circuits of wireless telephone 10 may adapt an anti-noise signal generated from the output of reference microphone R to have a characteristic that minimizes the amplitude of the ambient acoustic events at error microphone E. Because acoustic path P(z) extends from reference microphone R to error microphone E, ANC circuits are effectively estimating acoustic path P(z) while removing effects of an electro-acoustic path S(z) that represents the response of the audio output circuits of IC 20 and the acoustic/electric transfer function of speaker SPKR including the coupling between speaker SPKR and error microphone E in the particular acoustic environment, which may be affected by the proximity and structure of ear 5 and other physical objects and human head structures that may be in proximity to wireless telephone 10, when wireless telephone 10 is not firmly pressed to ear 5. While the illustrated wireless telephone 10 includes a two-microphone ANC system with a third near-speech microphone NS, some aspects of the present invention may be practiced in a system that does not include separate error and reference microphones, or a wireless telephone that uses near-speech microphone NS to perform the function of the reference microphone R. Also, in personal audio devices designed only for audio playback, near-speech microphone NS may not be included, and the near-speech signal paths in the circuits described in further detail below may be omitted, without changing the scope of the disclosure.

Figure 1B:
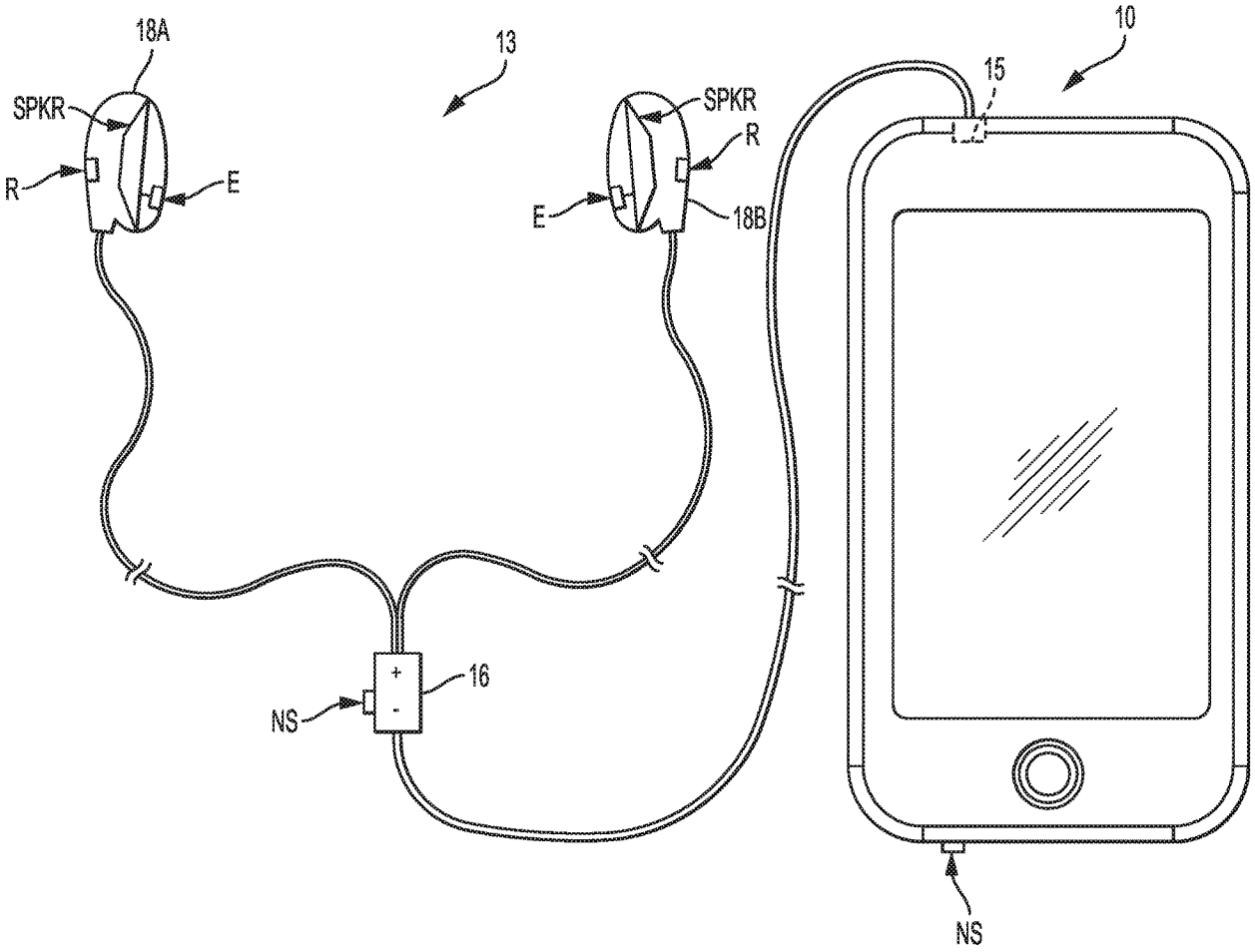
FIG. 1B is an illustration of an example wireless mobile telephone with a headphone assembly coupled thereto in accordance with embodiments of the present disclosure.

FIG. 1B is an illustration of an example wireless mobile telephone with a headphone assembly coupled thereto in accordance with embodiments of the present disclosure. In FIG. 1B, wireless telephone 10 is depicted having a headphone assembly 13 coupled to it via audio port 15. Audio port 15 may be communicatively coupled to RF integrated circuit 12 and/or IC 20, thus permitting communication between components of headphone assembly 13 and one or more of RF integrated circuit 12 and/or IC 20. As shown in FIG. 1B, headphone assembly 13 may include a combox 16, a left headphone 18A, and a right headphone 18B. As used in this disclosure, the term "headphone" broadly includes any loudspeaker and structure associated therewith that is intended to be mechanically held in place proximate to a listener's ear canal, and includes without limitation earphones, earbuds, and other similar devices. As more specific examples, "headphone," may refer to intra-concha earphones, supra-concha earphones, and supra-aural earphones.

Combox 16 or another portion of headphone assembly 13 may have a near-speech microphone NS that may capture near-end speech in addition to or in lieu of near-speech microphone NS of wireless telephone 10. In addition, each headphone 18A, 18B may include a transducer, such as speaker SPKR, that reproduces distant speech received by wireless telephone 10, along with other local audio events such as ringtones, stored audio program material, injection of near-end speech (i.e., the speech of the user of wireless telephone 10) to provide a balanced conversational perception, and other audio that requires reproduction by wireless telephone 10, such as sources from webpages or other network communications received by wireless telephone 10 and audio indications, such as a low battery indication and other system event notifications. Each headphone 18A, 18B may include a reference microphone R for measuring the ambient acoustic environment and an error microphone E for measuring of the ambient audio combined with the audio reproduced by speaker SPKR close to a listener's ear when such headphone 18A, 18B is engaged with the listener's ear. In some embodiments, IC 20 may receive the signals from reference microphone R, near-speech microphone NS, and error microphone E of each headphone and perform adaptive noise cancellation for each headphone as described herein. In other embodiments, an IC or another circuit may be present within headphone assembly 13, communicatively coupled to reference microphone R, near-speech microphone NS, and error microphone E, and configured to perform adaptive noise cancellation as described herein.

Figure 1C:
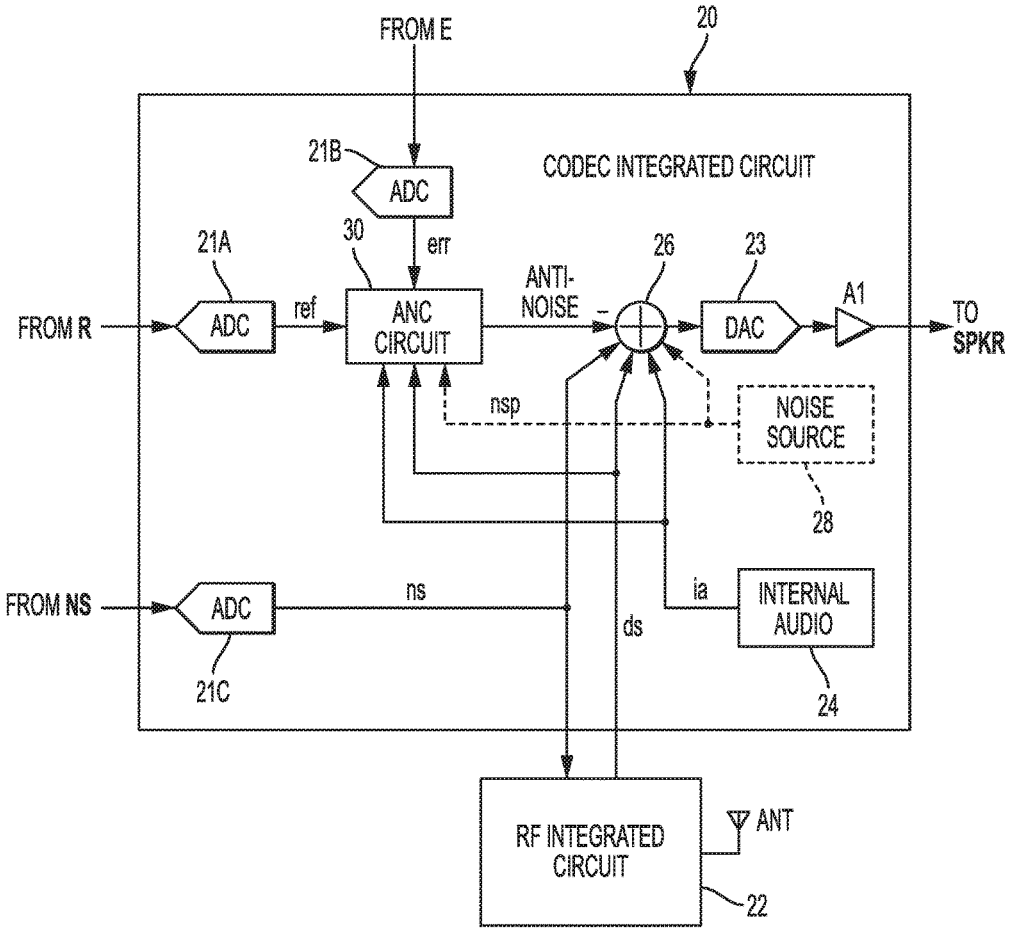
FIG. 1C is a block diagram depicting selected circuits within the wireless telephone depicted in FIG. 1A in accordance with embodiments of the present disclosure.

FIG. 1C is a block diagram of selected circuits within the wireless telephone depicted in FIG. 1A in accordance with embodiments of the present disclosure. In FIG. 1C, selected circuits within wireless telephone 10 are shown in a block diagram. IC 20 may include an analog-to-digital converter (ADC) 21A for receiving the reference microphone signal and generating a digital representation ref of the reference microphone signal, an ADC 21B for receiving the error microphone signal and generating a digital representation err of the error microphone signal, and an ADC 21C for receiving the near speech microphone signal and generating a digital representation ns of the near speech microphone signal. IC 20 may generate an output for driving speaker SPKR from an amplifier A1, which may amplify the output of a digital-to-analog converter (DAC) 23 that receives the output of a combiner 26. Combiner 26 may combine audio signals that is from internal audio sources 24, the anti-noise signal generated by ANC circuit 30, which by convention has the same polarity as the noise in reference microphone signal ref and is therefore subtracted by combiner 26, and a portion of near speech microphone signal ns so that the user of wireless telephone 10 may hear his or her own voice in proper relation to downlink speech ds, which may be received from radio frequency (RF) integrated circuit 22 and may also be combined by combiner 26. Near speech microphone signal ns may also be provided to RF integrated circuit 22 and may be transmitted as uplink speech to the service provider via antenna ANT. In some embodiments, combiner 26 may also combine a substantially inaudible noise signal nsp (e.g., a noise signal with low magnitude and/or in frequency ranges outside the audible band) generated from a noise source 28.

Figure 2:
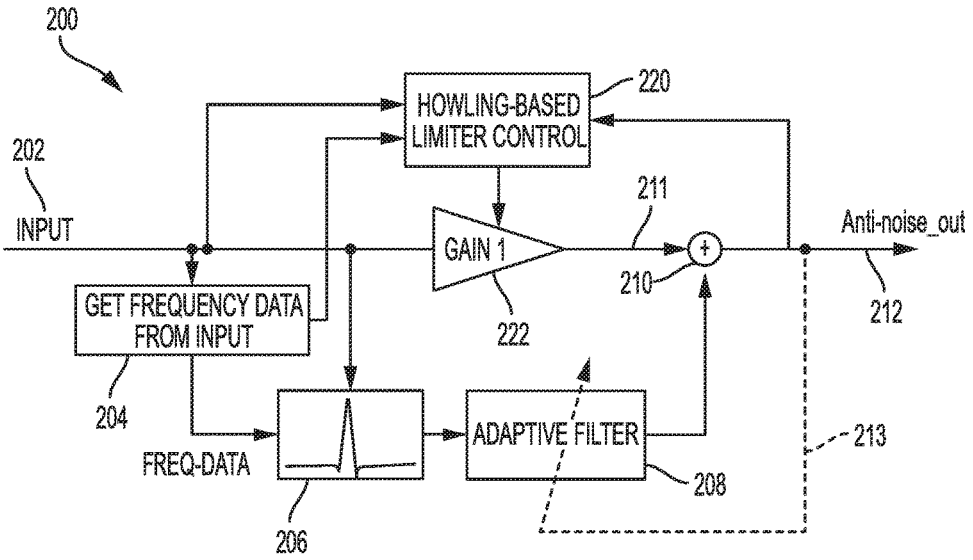
FIG. 2 is a block diagram depicting selected signal processing circuits and functional blocks within an example ANC circuit of a coder-decoder (CODEC) integrated circuit depicted in FIG. 1C in accordance with embodiments of the present disclosure.

FIG. 2 is a block diagram depicting selected signal processing circuits and functional blocks within an example ANC circuit of an IC depicted in FIG. 1C in accordance with embodiments of the present disclosure. The details illustrated in FIG. 2 are shown in accordance with embodiments of the present disclosure. ANC system 200 may be used in some embodiments to implement aspects of ANC circuit 30 depicted in FIG. 1C. The ANC system 200 illustrated in FIG. 2 may suppress a disturbance tone signal and/or a disturbance howl signal present in the input signal 202.

In some embodiments, an input signal 202 that includes audio disruption may be received from one or more of various sources. For example, the input signal 202 may be a signal corresponding to a signal received through reference microphone R, error microphone E, and/or near-speech microphone NS. For example, with reference to FIG. 1C, the input signal 202 may be a signal generated in ANC circuit 30, internal audio block 24, and/or noise source block 28. Accordingly, in some embodiments, input signal 202 may be an anti-noise signal generated in ANC circuit 30 illustrated in FIG. 1C.

A disturbance may be present in input signal 202, such as a tone signal and/or a howl signal. In some embodiments, the tone signal and/or the howl signal may be received through reference microphone R, error microphone E, and/or near-speech microphone NS. The disturbance may affect efficiency of the ANC circuit 30 and/or cause interruption to a user's audio playback. Embodiments of detection and reduction of such a disturbance are described with reference to FIGS. 2-6.

In some embodiments, ANC system performing tone and/or howl suppression may detect a first tone in an input signal at a first tone frequency and extract the detected first tone from the input signal. In ANC system 200, functional block 204 may represent the processing of the input signal 202 to obtain frequency data (freq_data) from the input signal 202 from which a first tone in the input signal may be detected at a first frequency. In some embodiments, the frequency data may alternatively or also be obtained from the Anti-noise_out signal 212. Block 206 may represent the processing of the input signal to extract the detected first tone from the input signal 202. In some embodiments, extraction of the detected first tone from the input signal 202, as performed at block 206, may be implemented with a band pass filter that filters the input signal 202. According to an embodiment, the band pass filter may have a center frequency equal to the first tone frequency associated with the detected first tone. Extraction may include, for example, storing a numerical value or values representing the first tone in a memory, such as a RAM or register. The extraction may alternatively be based on the information obtained from the input signal 202, such as the information obtained at block 204. In some embodiments, extraction may include processing the frequency data of the input signal 202 obtained at block 204 to obtain information related to the detected first tone and then generating the extracted first tone to be output from block 206 based on the processed tone information.

Regardless of how the first tone information is extracted from the input signal, the extracted first tone information may be output to an adaptive filter block 208. Adaptive filter block 208 may adaptively filter the extracted first tone to generate a second tone that has a magnitude that is approximately equal to a magnitude of the extracted first tone and a phase that is approximately opposite the phase of the extracted first tone.

The second tone generated by the adaptive filter 208 may be output to an adder 210. At adder 210, the second tone may be added to an intermediate signal 211 that is based, at least in part, on the input signal 202 to generate the output signal Anti-noise_out 212. By adding the second tone to the intermediate signal 211, the second tone approximately cancels the first tone in the input signal 202 that is also present in the intermediate signal 211 such that a presence of the first tone frequency is reduced or eliminated. The reduction of the first tone occurs because the magnitude of the second tone is approximately the same as the magnitude of the first tone detected in the input signal 202 and because the phase of the second tone is approximately opposite the phase of the first tone detected in the input signal 202. The addition of the two signals results in the tones canceling each other out such that the presence of a tone at the first tone frequency which was associated with the first tone is substantially reduced. In some embodiments, the addition of the signals may be delayed until the adaptive filter 208 converges to within a threshold margin of error to prevent addition of undesirable sounds to the output signal 212 as shown in FIG. 3B. Accordingly, output signal 212 may be output from the ANC system 200 to other blocks of a CODEC that includes ANC system 200 such that when the output signal 212, or a signal based, at least in part, on output signal 212, is output by a transducer, the sound output by the transducer may exhibit higher quality. In some embodiments, to generate the second tone, adaptive filter 208 may also process a feedback signal that is based, at least in part, on output signal Anti-noise_out 212. Feedback signal 213 may be fed back from the output 212 to adaptive filter 208 for processing by the adaptive filter 208 to generate the second tone.

Figure 3A:
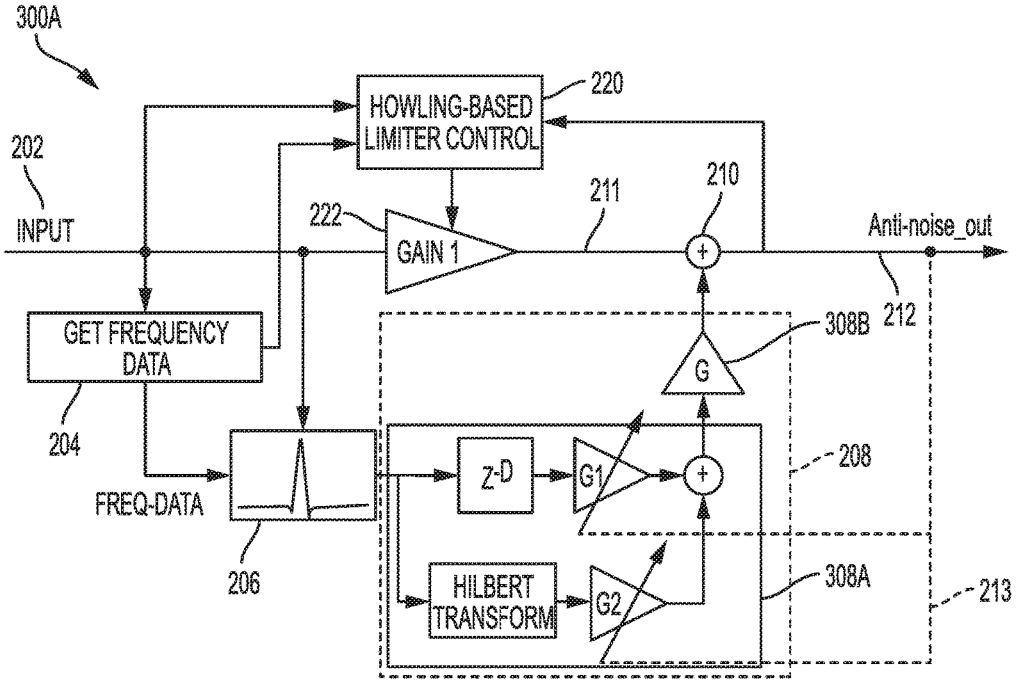
FIGS. 3A-B are block diagrams depicting examples of tone subtraction performed in an ANC system according to some embodiments of the disclosure.
Figure 3B:
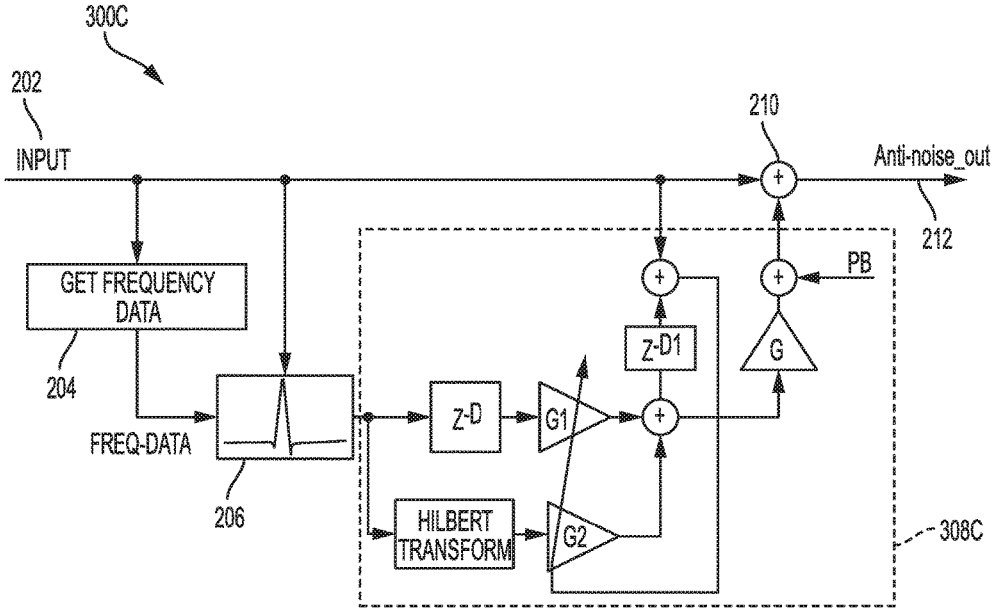

FIGS. 3A-3B are block diagrams depicting examples of tone subtraction performed in an ANC system according to some embodiments of the disclosure. For example, FIG. 3A depicts an ANC system 300A, similar to ANC system 200. The adaptive filter 208 may include a two-tap adaptive filter 308A and a gain block 308B. In other embodiments, the adaptive filter 308 may include only the two-tap adaptive filter 308A but not the gain block 308B. FIG. 3B depict other configurations for tone subtraction in ANC systems. FIG. 3B depicts an embodiment of an ANC system 300C with adaptive filter coefficient updating process separated from actual output, so the second tone can be output after the adaptive filter converges. One of skill in the art would readily understand that different aspects of the ANC systems illustrated in FIGS. 2 and 3A-3B may be combined in different combinations to create an ANC system in accordance with this disclosure, and that other implementations of the functional blocks illustrated in FIGS. 2 and 3A-3B may be used to create an ANC system in accordance with this disclosure.

In some embodiments, tone suppression as disclosed above may also result in suppression of howling effects. In addition to performing some howling effect suppression through tone suppression, an ANC system in accordance with embodiments of this disclosure may also include additional blocks for performing additional howling suppression. For example, referring to FIG. 2, ANC system 200 may also perform howling suppression with a limiter control block 220 and gain block 222. Gain block 222 may modify input signal 202 to generate an intermediate signal 211 with reduced howling effect compared to input signal 202.

To perform the additional howling suppression, system 200 may include a howling-based limiter control block 220 to determine whether the first tone is associated with a howling effect by determining the extent to which a howling effect is present on the input signal. As illustrated in FIG. 2, the determination of whether the first tone is associated with a howling effect may be based on the input signal 202, information obtained from the input signal 202 from block 204, and/or the output signal 212. In some embodiments, a power of the input signal 202 may be compared to a power of the output signal 212 to determine whether the first tone is associated with a howling effect. As an example, the input signal power compared to the output signal power may be the power of the input signal 202 in a wideband of frequencies that include at least the first tone frequency or just the power at the detected tone frequency. The output signal power used for the comparison may be the power of the output signal 212 in the same wideband of frequencies used to obtain the input signal power or just the power at the detected tone frequency. ANC system 200 may compare the powers and determine that the first tone is associated with a howling effect when the difference in power between the input signal and the output signal is less than a power difference threshold amount. The threshold may be a configurable value used to determine whether the tone was attenuated, and if not determine that howling exists. In addition, ANC system 200 may determine that the input signal includes howling effects that were not suppressed by tone suppression when the difference in power between the input signal and the output signal is less than an adjustable power difference threshold. ANC system 200 may determine that the first tone is associated with an ambient tone, rather than a howling effect, when the difference in power between the input signal and the output signal is greater than or equal to the adjustable power difference threshold. In some embodiments, ANC system 200 may also determine that the first tone is not associated with a howling disturbance when the difference in power between the input signal and the output signal is greater than or equal to the adjustable power difference threshold. The power difference threshold may be adjusted to meet various constraints, such as performance, signal strength, signal-to-noise ratio (SNR), memory, power, or complexity constraints. According to one embodiment, the power difference threshold may be 3 dB.

When the first tone is determined to be associated with a howling effect, ANC system 200 may apply a limiting function to the input signal 202 to generate the intermediate signal 211. For example, ANC system 200 may control gain block 222 from howling-based limiter control block 220 to apply a limiting function to the input signal 202 to generate the intermediate signal 211 when the first tone is determined to be associated with a howling effect. In some embodiments, applying a limiting function to the input signal 202 may include attenuating the input signal 202 when the power of the input signal 202 is greater than or equal to an adjustable input power threshold. According to certain embodiments, attenuating the input signal may include applying more attenuation when the input signal has a first power than when the input signal has a second power, wherein the first power is greater than the second power. In other embodiments, applying a limiting function to the input signal 202 may also include foregoing attenuation of the input signal 202 when the power of the input signal 202 is approximately greater than the adjustable input power threshold.

Figure 4A:
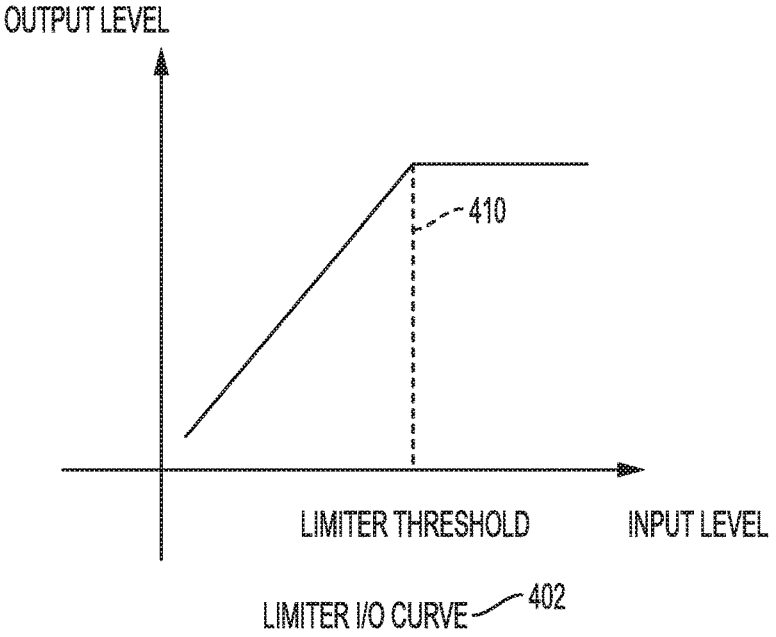
FIGS. 4A-B are block diagrams depicting signal limiting performed in an ANC system according to some embodiments of the disclosure.
Figure 4B:
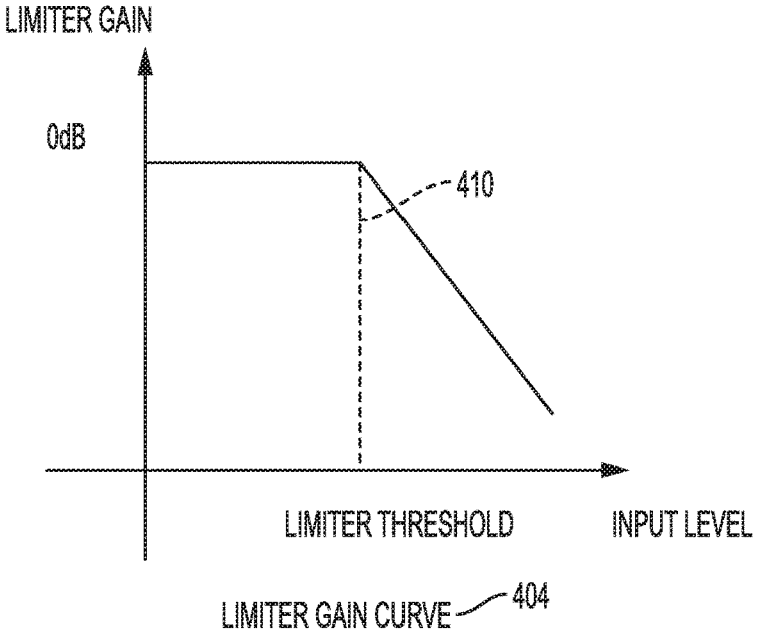

FIGS. 4A-B are block diagrams depicting signal limiting function performed in an ANC system according to some embodiments of the disclosure. The signal limiting depicted in FIG. 4 may illustrate the functionality of the limiting function applied to the input signal 202 to generate the intermediate signal 211. The input power threshold is depicted by limiter threshold 410. As illustrated in limiter gain curve 404 of FIG. 4B, when the power of the input signal 202 is approximately less than the adjustable input power threshold 410, no attenuation may be applied to the input signal 202. When the power of the input signal 202 is greater than or equal to an adjustable input power threshold 410, the input signal 202 may be attenuated, i.e., applying a limiting function to the input signal 202 may include attenuating the input signal 202 such that more attenuation is applied when the input signal has a first power than when the input signal has a second power, wherein the first power is greater than the second power.

Returning to FIG. 2, ANC system 200 may forego application of a limiting function to the input signal 202 when the first tone is determined to be associated with an ambient tone. In such a situation, the intermediate signal 211 may be approximately equal to the input signal 202, as is illustrated in FIG. 3B.

Figure 5:
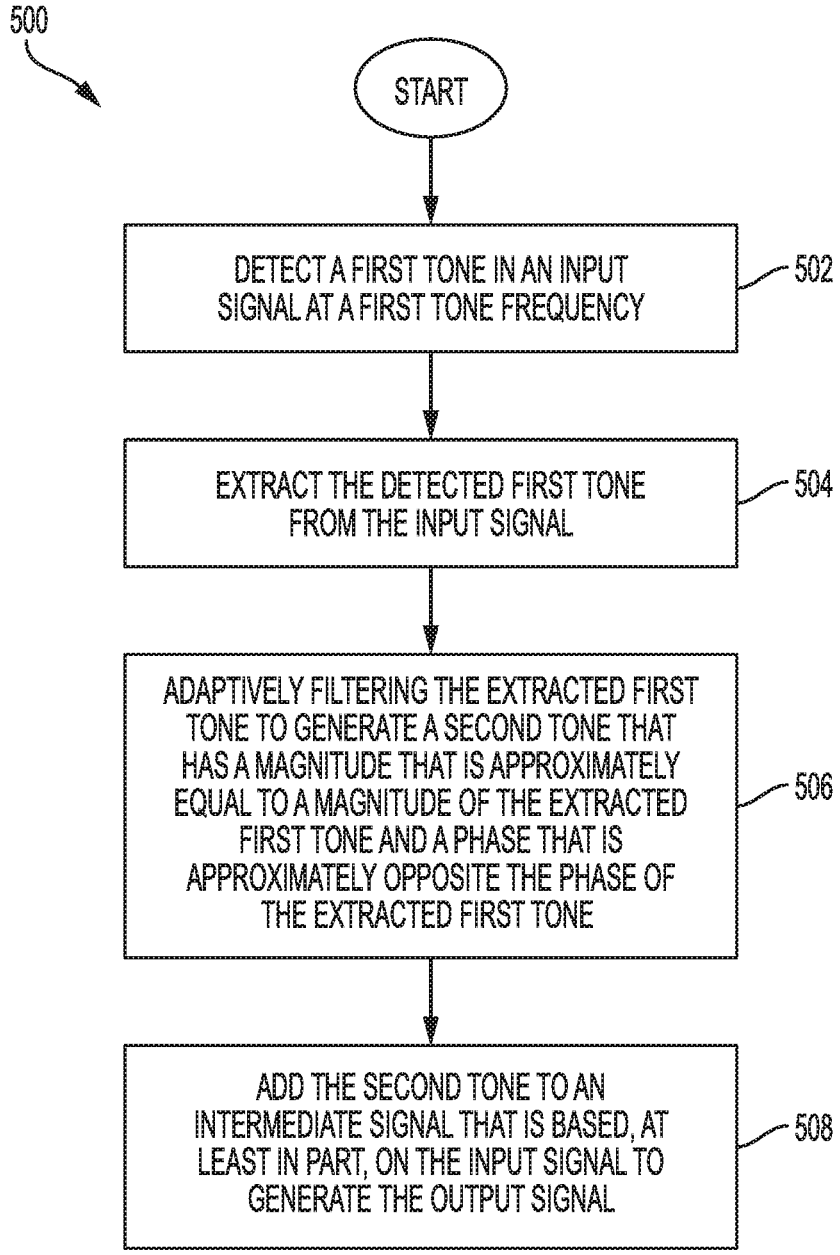
FIG. 5 is a flow chart illustrating an example method for tone and howl suppression in an ANC system according to one embodiment of the disclosure.

FIG. 5 is a flow chart illustrating an example method for tone and howl suppression in an ANC system according to one embodiment of the disclosure. Method 500 may be implemented with the systems described with respect to FIGS. 1-4 or other systems. Method 500 begins, at block 502, with detecting a first tone in an input signal at a first tone frequency. At block 504, method 500 includes extracting the detected first tone from the input signal. At block 506, method 500 includes adaptively filtering the extracted first tone to generate a second tone that has a magnitude that is approximately equal to a magnitude of the extracted first tone and a phase that is approximately opposite the phase of the extracted first tone. Method 500 also includes, at block 508, adding the second tone to an intermediate signal that is based, at least in part, on the input signal to generate the output signal.

Figure 6:
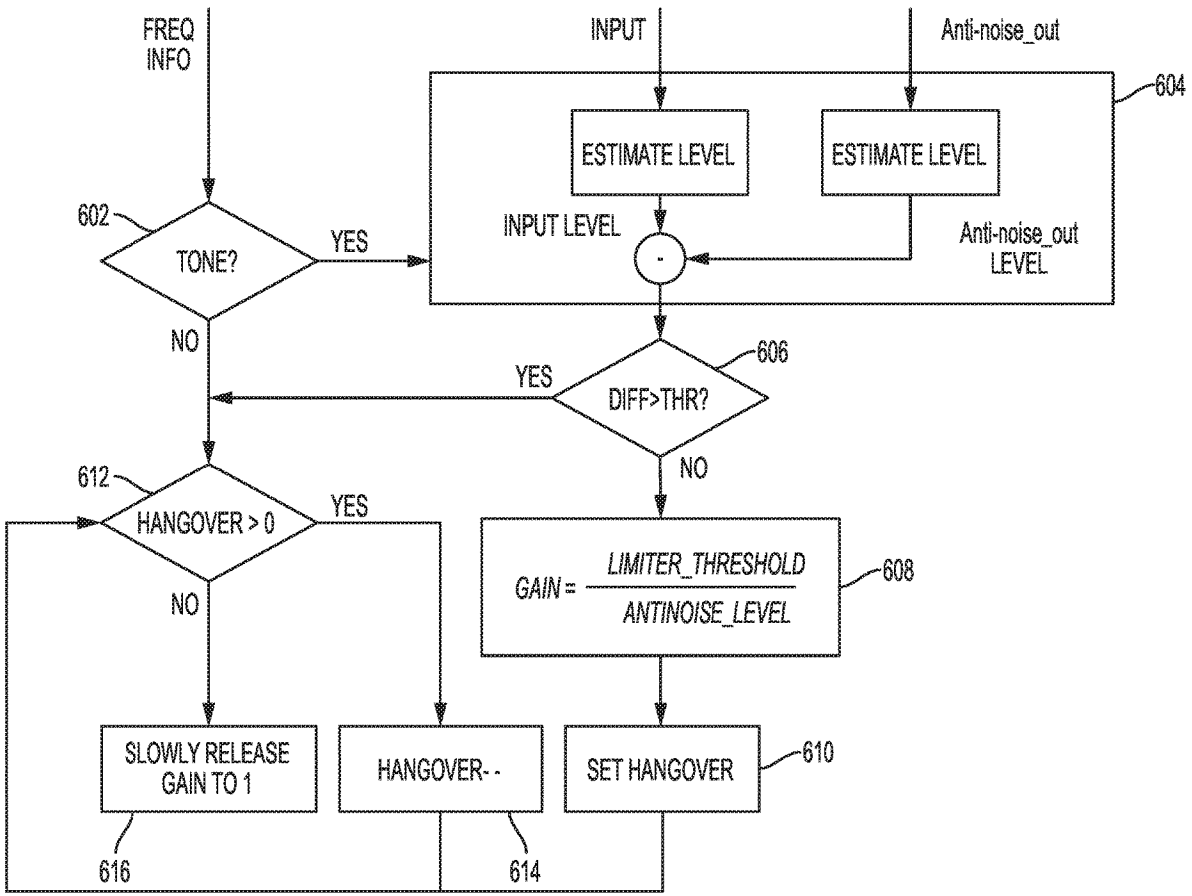
FIG. 6 is a flow chart illustrating an example method for howl suppression performed in an ANC system according to some embodiments of the disclosure.

FIG. 6 is a flow chart illustrating a scheme for howl suppression performed in an ANC system according to some embodiments of the disclosure. FIG. 6 illustrates functionality that may be performed by limiter control block 220 and other functional blocks illustrated in FIGS. 2-3. For example, FIG. 6 illustrates at block 602 that frequency data about an input signal may be processed to determine if there is a disturbance tone in the input signal. If a tone was detected at block 602, then, at block 604, a difference between the level of the input signal and the level of the output signal Anti-noise_out may be determined. In some embodiments, the level may be a power level. At block 606, the level difference may be compared to a threshold. In some embodiments, the level difference not exceeding the threshold used at block 606 may indicate that there is a howling disturbance in the input signal.

When the level difference determined at block 604 is less than the threshold, a gain may be determined at block 608. In some embodiments, the gain determined at block 608 may be the gain applied in an input signal path to reduce howling disturbance. By decreasing the anti-noise gain, howling may be suppressed. In some embodiments, the gain determined at block 608 may be applied by gain block 222 illustrated in FIGS. 2-3.

Based on the gain determined at block 608, a hangover value may be set at block 610. A hangover value may be a counter value that may be set when howling is detected, for example by detecting at block 606 that the level difference determined at block 604 does not exceed the threshold used at block 606. The hangover value may be set to a user-designated constant.

Block 612 may be reached when, at block 606, the level difference determined at block 604 is determined to be greater than the threshold used at block 606, which indicates that the howling disturbance is no longer present in the input/anti-noise signal. Block 612 may also be reached after the hangover value has been set at block 610. At block 612 a previously-set hangover value, such as the hangover value set at block 610, may be processed to determine if the value is greater than zero. If the hangover value processed at block 612 is determined to be greater than zero, then at block 614, the hangover value may be decremented and the hangover value may be processed again after being decremented. When the hangover value processed at block 612 is determined to not be greater than zero, then at block 616, the gain, such as the gain set at block 608 and applied via gain block 222 illustrated in FIGS. 2-3, may be released to unity, i.e., 1, such that eventually no gain is applied by gain block 222.

The schematic flow chart diagrams of FIGS. 5-6 are generally set forth as logical flow chart diagrams. As such, the depicted order and labeled steps are indicative of aspects of the disclosed methods. Other steps and methods may be conceived that are equivalent in function, logic, or effect to one or more steps, or portions thereof, of the illustrated methods. Additionally, the format and symbols employed are provided to explain the logical steps of the methods and are understood not to limit the scope of the methods. Although various arrow types and line types may be employed in the flow chart diagrams, they are understood not to limit the scope of the corresponding methods. Indeed, some arrows or other connectors may be used to indicate only the logical flow of the methods. For instance, an arrow may indicate a waiting or monitoring period of unspecified duration between enumerated steps of the depicted methods. Additionally, the order in which a particular method occurs may or may not strictly adhere to the order of the corresponding steps shown.

The operations described above may be performed by a controller, which can include any circuit configured to perform the described operations. Such a circuit may be an integrated circuit (IC) constructed on a semiconductor substrate and include logic circuitry, such as transistors configured as logic gates, and memory circuitry, such as transistors and capacitors configured as dynamic random access memory (DRAM), electronically programmable read-only memory (EPROM), or other memory devices. The logic circuitry may be configured through hard-wire connections or through programming by instructions contained in firmware. Further, the logic circuitry may be configured as a general-purpose processor (e.g., CPU or DSP) capable of executing instructions contained in software. The firmware and/or software may include instructions that cause the processing of signals described herein to be performed. The circuitry or software may be organized as blocks that are configured to perform specific functions. Alternatively, some circuitry or software may be organized as shared blocks that can perform several of the described operations. In some embodiments, the integrated circuit (IC) that is the controller may include other functionality. For example, the controller IC may include an audio coder/decoder (CODEC) along with circuitry for performing the functions described herein. Such an IC is one example of an audio controller. Other audio functionality may be additionally or alternatively integrated with the IC circuitry described herein to form an audio controller.

If implemented in firmware and/or software, functions described above may be stored as one or more instructions or code on a computer-readable medium. Examples include non-transitory computer-readable media encoded with a data structure and computer-readable media encoded with a computer program. Computer-readable media includes physical computer storage media. A storage medium may be any available medium that can be accessed by a computer.

By way of example, and not limitation, such computer-readable media can comprise random access memory (RAM), read-only memory (ROM), electrically-erasable programmable read-only memory (EEPROM), compact disc read-only memory (CD-ROM) or other optical disk storage, magnetic disk storage or other magnetic storage devices, or any other medium that can be used to store desired program code in the form of instructions or data structures and that can be accessed by a computer. Disk and disc includes compact discs (CD), laser discs, optical discs, digital versatile discs (DVD), floppy disks and Blu-ray discs. Generally, disks reproduce data magnetically, and discs reproduce data optically. Combinations of the above should also be included within the scope of computer-readable media.

In addition to storage on computer readable medium, instructions and/or data may be provided as signals on transmission media included in a communication apparatus. For example, a communication apparatus may include a transceiver having signals indicative of instructions and data. The instructions and data are configured to cause one or more processors to implement the functions outlined in the claims.

Although the present disclosure and certain representative advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. For example, although ANCs are described in embodiments above, aspects of the disclosed invention may also be applied to other noise cancellation systems. As another example, although processing of audio data is described, other data may be processed through the filters and other circuitry described above. As one of ordinary skill in the art will readily appreciate from the present disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. A method, comprising:

detecting a first tone in an input signal comprising an audio signal in an adaptive noise cancellation (ANC) system at a first tone frequency;

extracting the detected first tone from the input signal;

adaptively filtering the extracted first tone to generate a second tone that has a magnitude that is approximately equal to a magnitude of the extracted first tone and a phase that is approximately opposite the phase of the extracted first tone; and adding the second tone to an intermediate signal that is based, at least in part, on the input signal to generate the output signal for the adaptive noise cancellation (ANC) system.

2. The method of claim 1, wherein the step of extracting the detected first tone comprises one of:

band pass filtering the input signal with a band pass filter having a center frequency equal to the first tone frequency; and processing tone information for the detected first tone and generating the extracted first tone based on the processed tone information.

3. The method of claim 1, wherein the input signal comprises a reference signal or an anti-noise signal in an adaptive noise cancellation (ANC) system.

4. The method of claim 1, wherein the intermediate signal is the input signal.

5. The method of claim 1, further comprising:

determining whether the first tone is associated with a howling effect; and applying a limiting function to the input signal to generate the intermediate signal when the first tone is determined to be associated with a howling effect.

6. The method of claim 5, wherein the step of determining whether the first tone is associated with a howling effect comprises:

comparing a power of the input signal to a power of the output signal; and determining that the first tone is associated with a howling effect when the difference in power between the input signal and the output signal is less than a power difference threshold.

7. The method of claim 5, wherein applying a limiting function to the input signal comprises attenuating the input signal when the power of the input signal is greater than or equal to an adjustable input power threshold when a howling disturbance is detected.

8. The method of claim 7, wherein attenuating the input signal comprises applying more attenuation when the input signal has a first power than when the input signal has a second power, wherein the first power is greater than the second power.

9. An apparatus, comprising:

an audio controller configured to perform steps comprising:

detecting a first tone in an input signal at a first tone frequency;

extracting the detected first tone from the input signal;

adaptively filtering the extracted first tone to generate a second tone that has a magnitude that is approximately equal to a magnitude of the extracted first tone and a phase that is approximately opposite the phase of the extracted first tone; and adding the second tone to an intermediate signal that is based, at least in part, on the input signal to generate the output signal.

10. The apparatus of claim 9, wherein the step of extracting the detected first tone comprises one of:

band pass filtering the input signal with a band pass filter having a center frequency equal to the first tone frequency; and processing tone information for the detected first tone and generating the extracted first tone based on the processed tone information.

11. The apparatus of claim 9, wherein the input signal comprises a reference signal or an anti-noise signal in an adaptive noise cancellation (ANC) system.

12. The apparatus of claim 9, wherein the intermediate signal is the input signal.

13. The apparatus of claim 9, further comprising:

determining whether the first tone is associated with a howling effect; and applying a limiting function to the input signal to generate the intermediate signal when the first tone is determined to be associated with a howling effect.

14. The apparatus of claim 13, wherein the step of determining whether the first tone is associated with a howling effect comprises:

comparing a power of the input signal to a power of the output signal; and determining that the first tone is associated with a howling effect when the difference in power between the input signal and the output signal is less than an adjustable power difference threshold.

15. The apparatus of claim 13, wherein applying a limiting function to the input signal comprises attenuating the input signal when the power of the input signal is greater than or equal to an adjustable input power threshold.

16. The apparatus of claim 15, wherein attenuating the input signal comprises applying more attenuation when the input signal has a first power than when the input signal has a second power, wherein the first power is greater than the second power.

17. An apparatus, comprising:

a signal processing block configured to detect a first tone in an input signal at a first tone frequency, wherein the input signal comprises a reference signal or an anti-noise signal in an adaptive noise cancellation (ANC) system;

an extraction block configured to extract the detected first tone from the input signal;

an adaptive filter block configured to adaptively filter the extracted first tone to generate a second tone that has a magnitude that is approximately equal to a magnitude of the extracted first tone and a phase that is approximately opposite the phase of the extracted first tone; and an adder block configured to add the second tone to an intermediate signal that is based, at least in part, on the input signal to generate the output signal.

18. The apparatus of claim 17, wherein the extraction block is further configured to one of:

band pass filter the input signal with a band pass filter having a center frequency equal to the first tone frequency; and process tone information for the detected first tone and generate the extracted first tone based on the processed tone information.

19. The apparatus of claim 17, wherein the intermediate signal is the input signal.

20. The apparatus of claim 17, further comprising:

a control block configured to determine whether the first tone is associated with a howling effect; and a gain block configured to apply a limiting function to the input signal to generate the intermediate signal when the first tone is determined to be associated with a howling effect.

21. The apparatus of claim 20, wherein the control block is further configured to:

compare a power of the input signal to a power of the output signal; and determine that the first tone is associated with a howling effect when the difference in power between the input signal and the output signal is less than an adjustable power difference threshold.

22. The apparatus of claim 20, wherein the gain block is further configured to attenuate the input signal when the power of the input signal is greater than or equal to an adjustable input power threshold.

23. The apparatus of claim 22, wherein attenuating the input signal comprises applying more attenuation when the input signal has a first power than when the input signal has a second power, wherein the first power is greater than the second power.

* * * * *